US005685639A

United States Patent [19]

Green

[11] Patent Number: 5,685,639

[45] Date of Patent: Nov. 11, 1997

[54] JUICE MIXING NOZZLE

[75] Inventor: Thomas S. Green, Atwater, Ohio

[73] Assignee: ABC Dispensing Technologies Inc., Akron, Ohio

[21] Appl. No.: 629,023

[22] Filed: Apr. 8, 1996

[51] Int. Cl.[6] ..... B01F 13/02

[52] U.S. Cl. ..... 366/101; 366/163.2; 366/174.1; 366/175.2; 366/340; 220/145.5; 99/323.2

[58] Field of Search ..... 366/101, 163.1, 366/163.2, 165.1, 167.1, 175.2, 174.1, 176.1, 366, 340; 261/DIG. 16, DIG. 17; 99/323.1, 323.2; 222/129.3, 133, 145.5

[56] References Cited

U.S. PATENT DOCUMENTS

| | | | |
|---|---|---|---|
| 4,026,817 | 5/1977 | Ciuti et al. | 366/163.2 |
| 4,053,142 | 10/1977 | Johannes | 366/165.1 |
| 4,219,134 | 8/1980 | Wiesner | 366/175.2 |
| 4,552,286 | 11/1985 | Kiickens et al. | 99/323.1 |
| 4,960,042 | 10/1990 | Grossi | 261/DIG. 16 |
| 5,171,090 | 12/1992 | Wiemers | 366/163.2 |
| 5,295,431 | 3/1994 | Schiettecatte et al. | 99/323.1 |
| 5,330,266 | 7/1994 | Stubaus | 366/101 |

FOREIGN PATENT DOCUMENTS

| | | | |
|---|---|---|---|
| 185630 | 6/1986 | European Pat. Off. | 366/165.1 |
| 686806 | 9/1979 | U.S.S.R. | 366/165.1 |

*Primary Examiner*—David Scherbel
*Assistant Examiner*—Tony G. Soohoo
*Attorney, Agent, or Firm*—Renner, Kenner, Greive, Bobak, Taylor & Weber

[57] ABSTRACT

A juice mixing nozzle, which provides for the mixing of juice concentrate with water, includes a head which receives a manifold, a diffuser, and a cap to enclose the head. A supply of water, concentrate and air are directed through the cap and manifold into a mixing area where the water velocity is greatly increased to provide a "slicing" action to cut the concentrate and blend it with the water to make juice. After mixing, the juice is deflected by the diffuser to reduce the velocity thereof. The head also has a collection area to further reduce the velocity of the juice and minimize the splashing of the juice as it exits the head. The unique mixing action provided by the juice mixing nozzle allows for a mixing ratio of about five parts water to about one part concentrate.

15 Claims, 1 Drawing Sheet

JUICE MIXING NOZZLE

TECHNICAL FIELD

The invention herein resides generally in the art of nozzles for dispensing beverages. More particularly, the present invention relates to a nozzle for efficiently mixing juice concentrate with water. Specifically, the present invention relates to a nozzle that accommodates the effective production of juice from a highly concentrated concentrate, while reducing the velocity of the juice as it exits the nozzle.

BACKGROUND ART

In order to save on shipping and manufacturing costs, it is known to provide juice concentrate to an end-user who then mixes the concentrate with water to make juice. As such, it is desirable to have a high water to juice concentrate ratio. In other words, it is desirable to have a highly concentrated juice concentrate with a minimal amount of water therein, as water is an easily attainable ingredient in the mixing of juice. Additionally, as it impacts the final product, it is more expensive to ship juice concentrate that has a high water content as opposed to a juice concentrate with a low water content.

Currently, there are several known methods of mixing juice concentrate with water. One of these methods is to measure the appropriate amounts of concentrate and water into a container and then stir the two ingredients together until a homogenous juice solution is obtained. It is also known to provide a nozzle with multiple angularly directed ports, wherein the concentrate flows through the ports and intersects with the water to create a mixing action.

Although mixing is achieved by the above described methods, the manual mixing of the concentrate and water is considered a slow process especially where a large quantity of single cups must be dispensed, such as in a nursing home or the like. Another drawback is that the concentrate delivered by the aforementioned type of nozzle has a high level of water therein which increases the effective cost of shipping the concentrate. Additionally, the aforementioned nozzle is prone to failing to achieve a complete mixing of the concentrate and water. Additionally, if the juice is dispensed into individual cups directly from the nozzle, the correct ratio of concentrate to water may not be attained. The highest mixing ratio by known nozzles is three and one-half parts water to one part concentrate. In nozzles where the concentrate and water are directed into each other's path, a high pressure/high velocity flow of concentrate and water is required to obtain the correct mix. This causes the juice to splash into the cups, creating a messy mixing area.

Moreover, the ability to mix juice from a concentrate is adversely impacted by the temperature and resulting viscosity of the concentrate. When the concentrate is cold, it is not only difficult to move the concentrate, but it is similarly difficult to break up the concentrate and mix it.

Additionally, juices mixed from concentrates often differ from those prepared directly from fruit as "fresh squeezed," in that the concentrate-based juices typically do not have the head of foam which generally characterizes the fresh squeezed juices. Accordingly, even when the mixed juices have the same sweetness or "brix" and the same consistency as fresh juices, the absence of the head of foam suggests a lesser quality.

Based upon the foregoing, it is evident that there is a need in the art for an effective juice concentrate-water mixing system. Moreover, there is a need for a juice nozzle which generates a high velocity slicing action to mix water with highly concentrated or otherwise viscous juice concentrate. There is also a need to include a diffuser within the juice nozzle to reduce the splashing and velocity of the juice as it exits the nozzle. There is also a need for such a mixing system which generates a head of foam on the juice such that a mixed juice replicates fresh juice in all respects.

DISCLOSURE OF INVENTION

In light of the foregoing, it is a first aspect of the present invention to provide a juice mixing nozzle to effectively mix juice concentrate with water.

Another aspect of the present invention is to provide a juice mixing nozzle, with a mechanism for increasing the velocity of the incoming water to generate a "slicing" type spray to intersect with the incoming concentrate.

Still a further aspect of the present invention is to provide a juice mixing nozzle, as set forth above, wherein a venturi tube is received within the nozzle to provide a supply of air to assist in the mixing process.

Yet an additional aspect of the present invention is to provide a juice mixing nozzle, as set forth above, which employs a mechanism to reduce the velocity of juice concentrate and water after mixing, thus eliminating the splashing of juice as it exits the nozzle.

Still another aspect of the present invention is to provide a juice mixing nozzle, as set forth above, wherein the mixing ratio is greater than three and one-half parts water to one part juice concentrate.

An additional aspect of the invention is to provide a juice mixing nozzle, as set forth above, which generates a head of foam on the dispensed juice.

The foregoing and other aspects of the invention which shall become apparent as the detailed description proceeds, are achieved by a juice mixing nozzle, comprising: a head having an orifice; a manifold receiving a supply of water, a supply of concentrate and a supply of air, wherein the manifold is received within the head; a mechanism for increasing the velocity of the supply of water to mix with the supply of concentrate and the supply of air to form juice inside the head; and a mechanism for reducing the flow of the juice after mixing and prior to the juice exiting the orifice.

The present invention also provides a juice mixing nozzle for diluting a concentrate with water to form juice, comprising: a head having a manifold, the manifold receiving concentrate, water and air; a diffuser body received within the head, the diffuser body having a top surface, a water cavity and a plurality of channels; and a water tube for directing water from the manifold into the water cavity, the water cavity increasing the velocity of the water to optimize the mixing action of the concentrate, the water and the air to form juice, the juice flowing through the plurality of channels and exiting the head.

The present invention also provides a juice mixing nozzle, comprising: a head having an internal annular shoulder and a taper section extending inwardly therefrom, the taper section having an orifice; a manifold having a ledge and a plurality of apertures therethrough, the ledge received by the internal annular shoulder, the plurality of apertures directing water concentrate and air therethrough; a diffuser body carried by the head between the manifold and the orifice, the diffuser body having a water cavity and a plurality of channels about the periphery thereof; and a tube carrying the water and extending through one of the apertures and into the water cavity, wherein the water cavity increases the velocity of the water to optimize the mixing action of the water, the concentrate and the air to form juice and wherein the juice flows through the plurality of channels and out the orifice.

BRIEF DESCRIPTION OF THE DRAWINGS

For a complete understanding of the objects, techniques and structures of the invention, reference should be made to the following detailed description and accompanying drawings wherein.

BEST MODE FOR CARRYING OUT THE INVENTION

Figure 1:
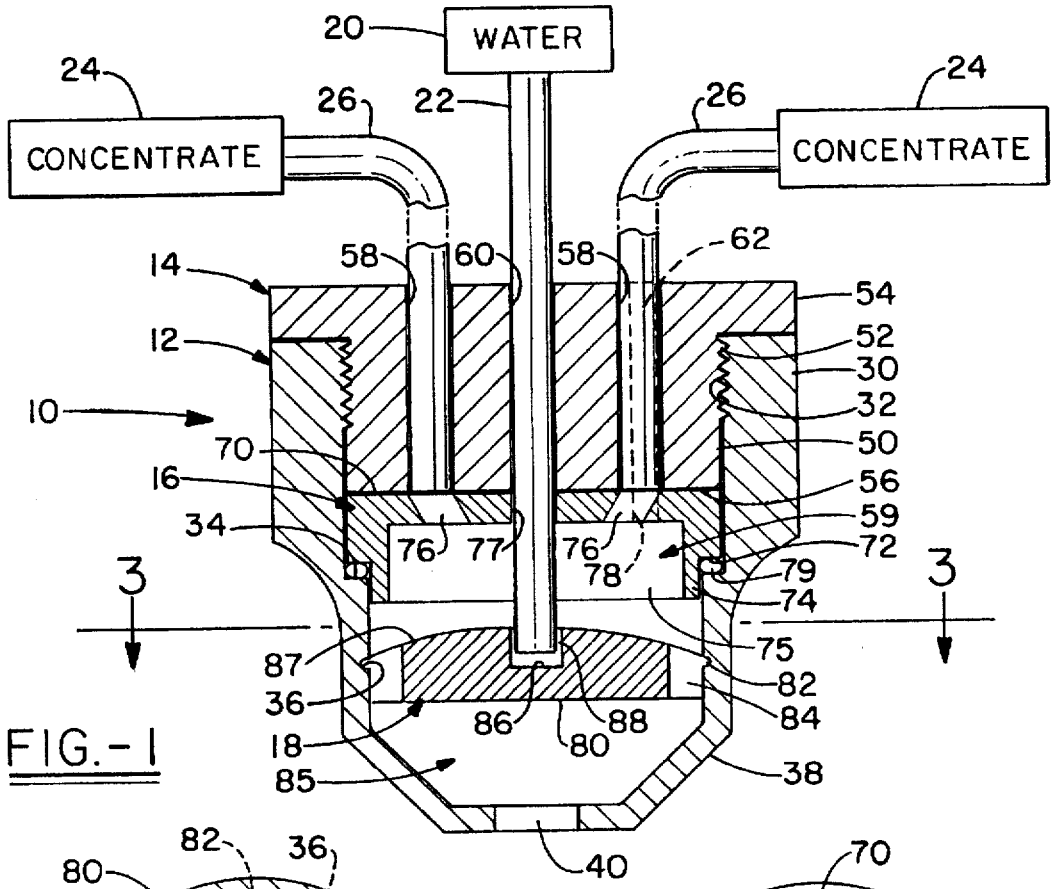
FIG. 1 is a cross-sectional schematic of the juice mixing nozzle according to the invention.

Referring now to all the drawings and in particular to FIG. 1, it can be seen that a juice mixing nozzle according to the present invention is designated generally by the numeral 10. Generally, the juice mixing nozzle 10 includes a head 12, a cap 14 to enclose the top of the head 12, a manifold 16 and a diffuser 18, both of which are received within the head 12. Connected to the nozzle 10 is a water supply 20 via a tube 22 and at least one concentrate supply 24 via a tube 26. It will be appreciated that a plurality of concentrate supplies 24 could be connected to the nozzle 10, where each supply 24 carries a different flavor of juice concentrate.

The primary purpose of the juice mixing nozzle 10 is to increase the velocity of the water from the water supply 20 to generate a spray that mixes with the juice concentrate from the concentrate supply 24 and optimizes the mixing thereof. In other words, the spray that is generated by the high velocity flow of the water "slices" or "cuts" the concentrate and effectively dilutes the concentrate to provide a homogenous juice. Another purpose of the nozzle 10 is to reduce the velocity of the juice after mixing to eliminate the possibility of splashing.

The head 12, which is generally tubular in construction, has a wall 30 with an interior and an exterior surface. The head 12 has a set of internal threads 32 to receive the cap 14. An annular shoulder 34 extends inwardly from the wall 30 to support and carry the manifold 16. The interior surface of the wall 30 also has a groove 36 which receives and carries the diffuser 18. Positioned below the groove 36 is a taper section 38 which is inwardly directed and terminates at an orifice 40 from which the juice exits after mixing.

The cap 14 includes a body 50 which has a set of external threads 52 that mate with the internal threads 32 of the head 12. Extending outwardly from the body 50 is a rim 54 that bears or seats on the top surface of the wall 30. The, body 50 also has a bottom surface 56. Extending through the body 50 are a plurality of concentrate apertures 58, which receive the tubes 26, for the purpose of delivering a predetermined supply of concentrate to a mixing area 59 of the nozzle 10. Also extending through the body 50 is a water aperture 60, which receives the water tube 22, for the purpose of directing water through the cap 14 and into the mixing area 59 of the nozzle 10. The body 50 also includes a venturi tube 62 which provides air to the mixing area 59 where the concentrate 24 and the water 20 are combined.

Figure 2:
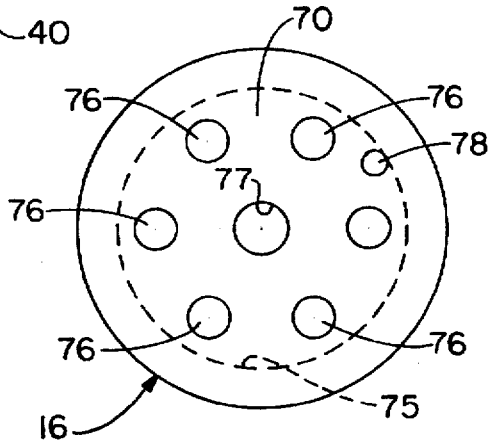
FIG. 2 is a top view of a manifold employed in the present invention.

The manifold 16 includes a support surface 70 which forms a ledge 72. Extending from the ledge 72 is a neck 74 which provides a neck cavity 75 in the interior portion of the manifold 16. Directed downwardly through the support surface 70 are a plurality of apertures 76 which correspond to and are aligned with the apertures 60 in the cap 14. Likewise, an aperture 77 corresponds to and is aligned with the aperture 50 in the cap 14 to receive the water tube 22. The manifold 16 also has an aperture 78 aligned with the venturi tube 62. Those skilled in the art will appreciate that the apertures 76, 77 and 78 function to transfer the concentrate, water and air through the manifold 16 and into the mixing area 59. As seen in FIGS. 1 and 2, the concentrate apertures 76 are circularly disposed around the water aperture 77. Moreover, the concentrate apertures 76 are angularly directed inwardly toward the center of the neck cavity 75. As a result, the concentrate 24 exits the appropriate aperture 76 and flows toward the center of the diffuser 18.

A seal 79 is disposed between the ledge 72 and the annular shoulder 34 of the head 12. The seal 79 is compressed by virtue of the bottom surface 56 bearing against the support surface 70. As those skilled in the art will appreciate the seal 79 precludes any contaminates from entering the mixing area 59 while also precluding the migration of juice out of the mixing area.

Figure 3:
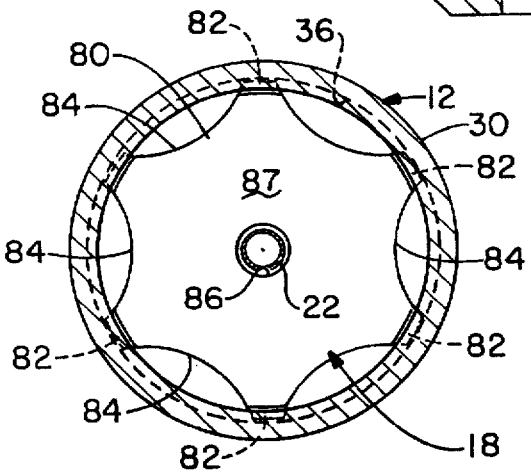
FIG. 3 is a cross-sectional view taken along lines 3—3 of FIG. 1 showing a diffuser employed in the present invention.
Figure 4:
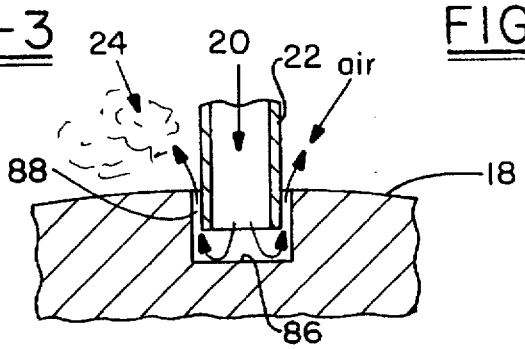
FIG. 4 is a schematic diagram of a water tube received in a water cavity to generate a high-velocity slicing action.

As seen in FIGS. 1, 3 and 4, the diffuser 18 includes a diffuser body 80 which has a snap ring 82 extending outwardly therefrom and which fits in the groove 36 of the head 12. The diffuser body 80 has a plurality of channels 84 disposed about the outer periphery thereof, wherein the channels 84 permit the mixed juice to flow from the mixing area 59 into a collection area 85 and out the orifice 40. Disposed in about the center of the diffuser body 80 is a water cavity 86 which receives the water tube 22. The diffuser body 82 has a top surface 87 which slopes downwardly from its center toward the outer periphery thereof. This downward slope assists in the flow of the juice out of the mixing area 59. As best seen in FIG. 4, the water tube 22 is of a smaller diameter than the water cavity 86 such that there is a slight clearance 88 therebetween. It has been found that a clearance of about 0.015 inches provides the optimum spacing between the water tube 22 and the water cavity 86. With the tube 22 having an O.D. of 0.25 inch and an I.D. of 0.187 inch, the diameter of the cavity 86 is preferably on the order of 0.28 inch. Of course, the tube 22 and cavity 86 will typically be tailored to other system parameters to achieve the desired mixing and cutting action as discussed below. It will further be appreciated that the end of the water tube 22 is positioned at or below the top surface 87 of the diffuser body 80. Although the diffuser body 80 includes the water cavity 86, it will be appreciated that the tube 22 could be received in other portions of the nozzle 10 where the velocity of the water is increased as it exits the tube 22 and enters the mixing area 59.

Based upon the structure disclosed hereinabove, it will be appreciated that the neck cavity 75, the top surface 87 and the interior surface of the wall 30 form the mixing chamber 59 wherein the concentrate 24, the water 20 and the air are mixed and combined. It will further be appreciated that the bottom of the diffuser 18, the orifice 40 and the taper section 38 define the collection area 85.

In use, the flow of the water 20 and concentrate 24 are regulated by a control system (not shown) whereby the dispensing pressures applied to both supplies are controlled.

When the control system determines that a certain amount of juice has been requested, the appropriate valves are opened and the concentrate and water flow into the mixing area 59. As this is done, air is pulled by venturi action through the venturi tube 62 to assist in the mixing action. Although the air in this embodiment of the juice nozzle 10 is dram from atmosphere, it will be appreciated that the control system could provide the necessary supply of air from a pressurized air supply. Water flows through the water tube 60 at a normal velocity determined by the pressure head forcing the water and the cross sectional area of the tube 60. As the water enters the water cavity 86 and attempts to exit out the restricted flow area provided by the clearance 88, the velocity of the water is greatly increased because of the greatly restricted flow area at the clearance 88. This increased velocity of water enters the mixing area 57 as a sharp spray which slices or cuts through the flow of concentrate 24 as the concentrate exits the angularly directed apertures 76 to quickly disperse it into a juice mixture. As seen in the drawings, the concentrate and water are deflected off the surfaces in the mixing area 59 and are combined to form a pleasant tasting, homogenized juice drink. In this same mixing area, air drawn through the venturi tube 62 is entrained in the juice to introduce a "head" on the juice when it is dispensed.

The development of a sharp cutting spray of water to engage the heavy concentrate is significant to the instant invention. The spray is generated by reversing the direction of the flow of the water while, at the same time, greatly reducing its flow path area. In a preferred embodiment, the clearance 88 defines a ring-like path having a cross sectional area on the order of 40–50 percent of the cross sectional area of the flow path of the tube 60. Of course, other parameters such as pressure, system drops, and the like impact the cutting and mixing operation of the mixing head 12 and, accordingly, each system must necessarily be tuned.

After the water and concentrate have been mixed in the mixing area 59, the juice then flows along the downwardly sloping top surface 87, through the channels 84 and down into the collection area 85. Although the diffuser body 80 reduces the velocity of the water and the concentrate within the mixing area 59, the taper section 38 functions to further reduce the velocity of the juice in the collection area 85. Once the velocity of the juice has been further reduced in the collection area 85, the juice exits the orifice 40 for receipt by a container such as a cup or pitcher.

As is apparent from the structure and operation disclosed herein, the juice mixing nozzle 10 presents numerous advantages. Primarily, the nozzle 10 provides a mechanism for mixing juice wherein the ratio of water to concentrate is greater than 3.5 to 1, and in the preferred embodiment is about five parts water to about one part concentrate. The generation of a sharp cutting spray of high velocity water to receive the concentrate allows the use of much heavier concentrates than in the prior art. Moreover, the mixing action presented within the mixing area 59 ensures a uniform blend to provide a pleasant tasting juice. The present juice mixing nozzle is also advantageous in that it entrains air in the mixed juice and reduces the velocity of the juice after mixing so that as the juice exits the nozzle 10 it does not splash or cause a mess as it enters the receiving receptacle, but forms a head therein. Still another advantage of the juice mixing nozzle 10 is that as the flavors of concentrate are changed, there is minimal cross-mixing therebetween. The juice mixing nozzle is also advantageous in that it is easy to disassembled and clean. Additionally, by virtue of the high mixing ratio, the cost of shipping concentrate is reduced.

Thus it can be seen that the objects of the invention have been attained by the structure presented above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A juice mixing noble, comprising:

a head having an orifice;

a manifold receiving a supply of water, a supply of concentrate and a source of air, said manifold received within said head; and means for increasing the velocity of said supply of water by providing a path of reduced flow area to increase the velocity of the water for mixing with said supply of concentrate and said source of air to form juice inside said head which exits from said orifice, said means for increasing including a tube for transferring said supply of water, and a diffuser body having a cavity to receive said tube, said cavity defining said path of reduced flow area to increase the velocity of the water to optimize the mixing of said supply of water and said supply of concentrate.

2. The juice mixing nozzle according to claim 1, further comprising:

means for reducing the rate of flow of the juice after mixing and prior to the juice exiting said orifice which includes said diffuser body received within said head to deflect the juice after mixing, said diffuser body having a plurality of channels to allow the juice to exit said orifice.

3. The juice mixing nozzle according to claim 1, wherein said increasing means allows the ratio of water to concentrate in said juice to be greater than 3.5 to 1.

4. The juice mixing nozzle according to claim 1, wherein said manifold, said head and said diffuser body define a mixing area.

5. The juice mixing nozzle according to claim 1, wherein said diffuser body, said head and said orifice define a collection area.

6. A juice mixing nozzle for diluting a concentrate with water to form juice, comprising:

a head having a manifold, said manifold receiving concentrate, water and air;

a diffuser body received within said head, said diffuser body having a top surface, a water cavity and a plurality of channels; and a water tube for directing water from said manifold into said water cavity, said water cavity increasing the velocity of said water to optimize the mixing action of the concentrate, the water and the air to form juice, the juice flowing through said plurality of channels and exiting said head.

7. The juice mixing nozzle according to claim 6, wherein said head, said manifold and said diffuser body define a mixing area where the flow of the water exiting the water cavity intersects with the flow of the concentrate and the air exiting said manifold in said mixing area to form juice.

8. The juice mixing nozzle according to claim 7, wherein said head has an orifice and wherein said diffuser body and said head define a collection area above said orifice and wherein said juice flows from said mixing area through said plurality of channels into said collection area and out said orifice.

9. The juice mixing nozzle according to claim 8, wherein said diffuser body allows the ratio of water to concentrate to be greater than 3.5 to 1.

10. The juice mixing nozzle according to claim 9, wherein the end of said water tube is received within said water cavity at a level below said top surface of said diffuser body, and wherein said water tube and said water cavity define a clearance for the water to enter said mixing area, said clearance defining a water flow path having a cross sectional area on the order of 40–50 percent of a cross sectional area of a water flow path defined by said water tube.

11. The juice mixing nozzle according to claim 10, wherein said clearance is about 0.015 inch between said water cavity and said water tube.

12. A juice mixing nozzle, comprising:

a head having an internal annular shoulder and a tapered section extending inwardly therefrom, said tapered section having an orifice;

a manifold having a ledge and a plurality of apertures therethrough, said ledge received by said internal annular shoulder, said plurality of apertures directing water, concentrate and air therethrough;

a diffuser body carried by said head between said manifold and said orifice, said diffuser body having a water cavity and a plurality of channels about the periphery thereof; and a tube carrying water and extending through one of said apertures and into said water cavity, wherein said water cavity increases the velocity of said water to optimize the mixing action of the water, the concentrate and the air to form juice and wherein the juice flows through said plurality of channels and out said orifice.

13. The juice mixing nozzle according to claim 12, wherein said manifold has a neck downwardly extending from said ledge, said neck having a neck cavity into which said plurality of apertures enter, said neck, said head and said diffuser body forming a mixing area where the juice is mixed.

14. The juice mixing nozzle according to claim 13, wherein said diffuser body deflects the velocity of the water and mixed juice prior to the juice entering said collection area.

15. The juice mixing nozzle according to claim 14, wherein said water cavity allows the ratio of water to concentrate received in said mixing area to be greater than 3.5 to 1.

* * * * *